US010352179B2

(12) United States Patent
Escuret et al.

(10) Patent No.: US 10,352,179 B2
(45) Date of Patent: Jul. 16, 2019

(54) COMPRESSION ASSEMBLY FOR A TURBINE ENGINE

(71) Applicant: Turbomeca, Bordes (FR)

(72) Inventors: Jean-François Escuret, Idron (FR); Pierre Biscay, Lons (FR); Guillaume Sevestre, Gelos (FR)

(73) Assignee: SAFRAN HELICOPTER ENGINES, Bordes (FR)

( * ) Notice: Subject to any disclaimer, the term of this patent is extended or adjusted under 35 U.S.C. 154(b) by 488 days.

(21) Appl. No.: 14/438,580

(22) PCT Filed: Nov. 7, 2013

(86) PCT No.: PCT/FR2013/052660
§ 371 (c)(1),
(2) Date: Apr. 24, 2015

(87) PCT Pub. No.: WO2014/072642
PCT Pub. Date: May 15, 2014

(65) Prior Publication Data

US 2015/0275681 A1 Oct. 1, 2015

(30) Foreign Application Priority Data

Nov. 9, 2012 (FR) ..... 12 60637

(51) Int. Cl.
*F01D 17/16* (2006.01)
*F01D 7/00* (2006.01)
(Continued)

(52) U.S. Cl.
CPC ..... *F01D 7/00* (2013.01); *F01D 1/02* (2013.01); *F01D 9/02* (2013.01); *F04D 29/544* (2013.01); *F04D 29/563* (2013.01)

(58) Field of Classification Search
CPC ..... F01D 9/02; F01D 17/162; F01D 17/14; F01D 5/141; F01D 5/142; F01D 5/143; F04D 29/444; F04D 29/462; F04D 29/544
See application file for complete search history.

(56) References Cited

U.S. PATENT DOCUMENTS 5,794,432 A * 8/1998 Dunbar ..... F01D 17/162 60/204
8,672,618 B2 3/2014 Guemmer
2010/0232936 A1* 9/2010 Mielke ..... F01D 17/162 415/160

FOREIGN PATENT DOCUMENTS

EP 0 477 740 A1 4/1992
EP 2 189 664 A2 5/2010
(Continued)

OTHER PUBLICATIONS

International Search Report dated Jan. 16, 2014, issued in corresponding International Application No. PCT/FR2013/052660, filed Nov. 7, 2013, 3 pages.
(Continued)

*Primary Examiner* — Justin D Seabe
*Assistant Examiner* — Sabbir Hasan
(74) *Attorney, Agent, or Firm* — Christensen O'Connor Johnson Kindness PLLC

(57) ABSTRACT

Compression assembly for a turbine engine, in particular a turboshaft engine, said assembly comprising an air inlet duct capable of receiving an air flow, at least one air compression stage comprising at least one movable compressor wheel onto which the duct discharges, and a pre-rotation grille which is positioned in the air inlet duct upstream of the movable compressor wheel in order to adjust the speed of the air in said flow at the inlet of the movable wheel and comprises a plurality of variable-setting vanes, the assembly
(Continued)

being characterized in that the pitch between two consecutive vanes of the grille is greater than the chord of one of the two vanes at a given height of the air duct, preferably in its upper part.

7 Claims, 2 Drawing Sheets

(51) Int. Cl.

| | |
|---|---|
| ***F04D 29/54*** | (2006.01) |
| ***F04D 29/56*** | (2006.01) |
| ***F01D 1/02*** | (2006.01) |
| ***F01D 9/02*** | (2006.01) |

(56) References Cited

FOREIGN PATENT DOCUMENTS

| | | |
|---|---|---|
| GB | 2 405 184 A | 2/2005 |
| WO | 98/09066 A1 | 3/1998 |

OTHER PUBLICATIONS

Written Opinion of the International Searching Authority dated Jan. 16, 2014, issued in corresponding International Application No. PCT/FR2013/052660, filed Nov. 7, 2013, 9 pages.

International Preliminary Report on Patentability dated May 12, 2015, issued in corresponding International Application No. PCT/FR2013/052660, filed Nov. 7, 2013, 1 page.

* cited by examiner

COMPRESSION ASSEMBLY FOR A TURBINE ENGINE

FIELD OF THE DISCLOSURE

Embodiments of the disclosure relate to the field of turbine engines, in particular for aircraft. Embodiments of the disclosure more particularly relate to a compression assembly for a turbine engine, in particular for a helicopter turboshaft engine, and to a turbine engine equipped with an assembly of this type.

BACKGROUND

In a known manner, a turboshaft engine comprises a compression assembly comprising an air inlet duct and at least one air compression stage, or compressor, which comprises at least one movable compressor wheel onto which the duct discharges.

Compression assemblies of this type have an aerodynamic stability limit, commonly referred to as a surge line, which in particular limits the acceleration capacity of the turboshaft engine. At low operating speeds, the aerodynamic stability limit of the compression assembly is linked to an aerodynamic overload of the first compression stage, thereby resulting in too heavy an impact of the air flow reaching the first movable wheel.

A known solution, described in the patent application FR2970508, filed by the applicant, consists in mounting a grille, referred to as a pre-rotation grille, in the air inlet duct of the turboshaft engine upstream of the first movable compressor wheel in order to reduce the impact of the air flow reaching the first movable wheel by orienting the grille in the rotational direction of the first movable wheel.

A pre-rotation grille of this type comprises orientable inlet guide vanes, referred to as variable-pitch vanes, which are mounted on a casing and are evenly distributed within the air inlet duct. The grille is set, that is to say the vanes are oriented, via a control ring, and this allows the speed of the air flow at the inlet of the movable wheel to be adjusted, so as to adapt the impact of the air flow reaching the first movable wheel.

A known arrangement of such a pre-rotation grille consists in arranging the vanes of the grille such that the pre-rotation angle of the vanes and therefore the angle of orientation of the air flow can change depending on the height in the air duct, the angle of orientation of the air flow being defined as being the relative deflection of the air flow by a vane of the pre-rotation grille at a given height of the air duct. In other words, the angle of orientation of the air flow varies with the radial distance in the air inlet duct relative to the shaft of the turboshaft engine.

FIGS. 1 to 3 are schematic cross sections of the head of an assembly of two vanes 10 of a pre-rotation grille 5 and two blades 20 of a movable compressor wheel 15 from the prior art. The consecutive vanes 10 of the grille 5 are spaced apart by a distance S1 referred to as the "pitch". Each vane 10 has a curved cross section and defines a chord C1 between the upstream end and the downstream end of the vanes 10, that is to say between the leading edge and the trailing edge of the vane 10.

When the pre-rotation grille 5 is open at high operating speeds of the compressor, for example for a setting value of the control ring (not shown) of the pre-rotation grille 5 that is equal to 0°, the pre-rotation angle of the vanes 10 of the grille 5 is normally between values of approximately 0° at the bottom of the air duct and up to approximately 15° at the top of the air duct (relative to the axis X-X). The air flow F entering the grille is therefore deflected by an angle of orientation $\alpha_1$ which is close to the pre-rotation angle of the vanes and is between 0° and 15° according to the height in the air duct at an absolute speed $V_1$ at the outlet of the grille, where the axial component (along the axis X'X) is Vz1. Such a setting of the grille 5 is used for high operating speeds of the compressor, in particular at the maximum operating speed, for example during take-off in the case of a helicopter turboshaft engine.

At low operating speeds of the compressor, as shown in FIG. 2, the grille 5 is closed at least in part in order to reduce the aerodynamic load and to increase the surge margin by moving the surge line of the compressor towards low flow rates, while moving the operating line towards high flow rates, thereby allowing a high acceleration capacity of the turboshaft engine to be obtained. In such an arrangement, the control ring (not shown) of the pre-rotation grille 5 is normally set to a value, for example approximately 65°, for which the pre-rotation angle of the vanes 10 of the grille 5 is between 65° and 80° depending on the height of the flow in the air duct.

At high operating speeds of the turboshaft engine (open grille), when the relative speed W1 of the air flow reaching the first movable wheel 15 of the compressor at the top of the air duct is high, for example such that the relative Mach number at the head of the movable wheel is greater than 1.4, the pre-rotation angle of the vanes 10 of the grille 5 should be increased beyond 15° at the top of the air duct, for example up to 20°, in order to significantly reduce the relative speed W1 of the air at the inlet of the movable wheel 15 and to thus significantly improve the efficiency of the compression.

However, in such an arrangement, when the control ring of the pre-rotation grille 5 is set to a closure value of the grille 5, for example approximately 65°, at low speeds, as shown in FIG. 2, the pre-rotation angle of the vanes reaches approximately 85° at the top of the air duct, that is to say that the air flow is deflected by an angle of orientation $\alpha$1 that is close to approximately 85° by the vanes 10 in the uppermost part of the duct, in particular in the region of the distal end of the vanes 10. In such a case, the axial speed Vz1, along the axis X-X, of the air flow at the outlet of the pre-rotation grille 5 at the top of the air duct becomes so low that it may cause the blades 20 of the movable wheel 15 of the compressor to aerodynamically malfunction. In other words, the boundary layers of the air no longer hold to the shape of the head profiles of the blades 20 of the movable wheel 15, and this may cause an aerodynamic stall within the movable wheel 15, which is commonly referred to as a rotating stall, which is detrimental to the aerodynamic stability of the compressor and is therefore a drawback.

An immediate solution to overcome this drawback would be to adjust the control ring to a low value at low speeds, for example of approximately 50° or 60°, in order to close the pre-rotation grille by a slightly lesser degree and to increase the axial speed Vz1 of the air flow at the top of the air duct. However, such an adjustment would reduce the angles of orientation of the air flow for the remainder of the height of the air duct, which is a drawback.

SUMMARY

Embodiments of the disclosure aim to improve the structure of the existing pre-rotation grilles by increasing the pre-rotation angle of the vanes beyond 15° at the top of the air duct at high operating speeds of the turboshaft engine, while preventing aerodynamic malfunctions of the blades of the movable wheel at low operating speeds of the turboshaft engine.

Although the disclosure has been developed for an aircraft turboshaft engine, it relates to any compression assembly of a turbine engine comprising a pre-rotation grille, such as that in turboshaft engines, turbojet engines, auxiliary power units (APU), terrestrial turbine engines, turbocompressors, etc. It also relates to any type of compressor, whether it is axial, centrifugal, mixed, etc.

Therefore, the disclosure relates to a compression assembly for a turbine engine, in particular a turboshaft engine, the assembly comprising an air inlet duct configured to receive an air flow, at least one air compression stage comprising at least one movable compressor wheel onto which the duct discharges, and a pre-rotation grille which is positioned in the air inlet duct upstream of the movable compressor wheel in order to adjust the speed of the air in the flow at the inlet of the movable wheel and comprises a plurality of variable-setting vanes, the assembly being distinctive in that the pitch between two consecutive vanes of the grille is greater than the chord of one of the two vanes at a given height of the air duct.

The term "pitch" means the distance between two identical points on two vanes of the grille which are arranged consecutively. The term "chord" means the distance between the segment extending between the upstream end and the downstream end and a vane of the pre-rotation grille, that is to say between the end of the leading edge and the end of the trailing edge of a vane of the pre-rotation grille. The terms "upstream" and "downstream" are in relation to the direction of the air flow circulating in the turbine engine.

Advantageously, the pitch between two consecutive vanes is greater than the chord of one of the two vanes in the upper part of the air duct, for example in the region of the distal ends of the vanes. The expression "upper part of the air duct" means the part of the air duct that is radially the furthest from the longitudinal axis of the turboshaft engine. The expression "at the top of the air duct" means the distal end of the vane relative to the longitudinal axis of the turboshaft engine. Similarly, the expression "lower part of the duct" means the part of the duct that is closest to the longitudinal axis of the turboshaft engine. The expression "at the bottom of the air duct" means the proximal end of the vane relative to the longitudinal axis of the turboshaft engine.

In the prior art solutions, the pitch between the distal ends of two consecutive vanes of the pre-rotation grille is less than or equal to the chord of one vane of the grille. In other words, the ratio of the pitch to the chord (S1/C1) is between 0.9 and 1. The vanes of the grille thus overlap in part in the closed position of the grille, thereby significantly reducing the axial speed of the air flow at low speeds and causing the above-mentioned aerodynamic malfunctions.

In the compression assembly according to the disclosure, since the pitch between two consecutive vanes of the grille is greater than the chord of one of the two vanes, the vanes no longer cover one another in the closed position of the grille as in the prior art solutions, thereby allowing vanes to be used of which the pre-rotation angle is greater than 15° in the upper part of the air duct at high operating speeds of the compressor stage (with the pre-rotation grille being set to be open very wide), while allowing efficient aerodynamic operation of the movable compressor wheel at low speeds (with the pre-rotation grille being set to be closed to a high degree).

According to an embodiment, the pre-rotation angle of the vanes is greater than 15° in the upper part of the air duct, in particular in the region of the distal ends thereof, and preferably between 15° and 25°, when the pre-rotation grille is in the open position for high operating speeds of the compression stage, for example for a setting value of the control ring of the grille of 0°. Therefore, when the relative speed of the air flow reaching the first movable compressor wheel is high, for example such that the relative Mach number at the head of the movable wheel is greater than 1.4, such a range of values for the pre-rotation angle of the vanes of the grille in the upper part of the air duct allows the relative speed of the air flow at the maximum operating speed of the compressor to be sufficiently reduced so as to significantly improve the efficiency of the compression stage.

Preferably, the pre-rotation angle of the vanes is between 80° and 90° in the upper part of the air duct, in particular in the region of the distal ends thereof, when the pre-rotation grille is in the closed operating position at low speeds of the compression stage, for example for a setting value of the control ring of the grille of 65°. In such a case, given that the pitch between two consecutive vanes is greater than the chord of a vane, the spacing of the vanes in the closed position of the grille allows an axial speed of the air flow to be obtained that is greater than the axial speed of the flow in a prior art assembly for the same setting of the control ring of the pre-rotation grille. In other words, the spacing of the vanes allows the axial speed of the air flow passing through the pre-rotation grille to be increased, in particular being set to be closed to a high degree, so as to prevent aerodynamic malfunctions of the blades of the movable compressor wheel.

Preferably, the vanes of the grille extend radially with respect to the shaft of the turbine engine and are configured such that the pre-rotation angle of the vanes of the pre-rotation grille changes in the air duct with the radial distance. In order to do this, the vanes may for example be twisted.

Preferably, the pre-rotation angle is approximately equal to 0° at the bottom of the air duct, that is to say radially closest to the shaft of the turboshaft engine, and is approximately 25° at the top of the air duct, that is to say radially furthest away from the shaft of the turboshaft engine, for a setting value of the control ring of the grille of 0°.

According to an embodiment, the chord of the vanes is constant for the plurality of vanes of the pre-rotation grille.

According to an embodiment, the pre-rotation grille is positioned in a radial part, a curved part or an axial part of the air inlet duct. The terms "radial part" and "axial part" mean relative to the shaft of the turbine engine.

Advantageously, the vanes are arranged so as to be evenly distributed within the air inlet duct. In other words, the pitch between the vanes of the grille is constant.

The disclosure also relates to a turbine engine, such as a turboshaft engine, in particular for an aircraft, such as a helicopter, comprising an air inlet duct configured to receive an air flow, at least one air compression stage comprising at least one movable compressor wheel onto which the duct discharges, and a pre-rotation grille which is positioned in the air inlet duct upstream of the movable compressor wheel in order to adjust the speed of the air in the flow at the inlet of the movable wheel and comprises a plurality of variable-setting vanes, the assembly being distinctive in that the pitch between two consecutive vanes of the grille is greater than the chord of one of the two vanes at a given height, preferably in the upper part, of the air duct.

The disclosure also relates to a method for controlling a pre-rotation grille of a compression assembly, as defined above, comprising an air inlet duct configured to receive an air flow, at least one air compression stage comprising at least one movable compressor wheel onto which the duct discharges, and a pre-rotation grille which is positioned in the air inlet duct upstream of the movable compressor wheel in order to adjust the speed of the air in the flow at the inlet of the movable wheel and comprises a plurality of variable-setting vanes, the method being distinctive in that, since the pitch between two consecutive vanes of the grille is greater than the chord of one of the two vanes at a given height of the air duct, preferably in its upper part in particular in the region of the distal ends thereof, the vanes of the grille are positioned at a pre-rotation angle of between 80° and 90° at low operating speeds of the compression stage.

The disclosure also relates to a method for controlling a pre-rotation grille of a compression assembly, as defined above, comprising an air inlet duct configured to receive an air flow, at least one air compression stage comprising at least one movable compressor wheel onto which the duct discharges, and a pre-rotation grille which is positioned in the air inlet duct upstream of the movable compressor wheel in order to adjust the speed of the air in the flow at the inlet of the movable wheel and comprises a plurality of variable-setting vanes, the method being distinctive in that, since the pitch between two consecutive vanes of the grille is greater than the chord of one of the two vanes at a given height of the air duct, preferably in its upper part in particular in the region of the distal ends thereof, the vanes of the grille are positioned at a pre-rotation angle of greater than 15°, preferably of between 15° and 25°, at high operating speeds of the compression stage.

DESCRIPTION OF THE DRAWINGS

The foregoing aspects and many of the attendant advantages of the claimed subject matter will become more readily appreciated as the same become better understood by reference to the following detailed description, when taken in conjunction with the accompanying drawings, wherein:

DETAILED DESCRIPTION

The detailed description set forth below in connection with the appended drawings, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed.

Although the disclosure has been implemented within the context of a helicopter turboshaft engine, it of course may be used in any compression assembly comprising a pre-rotation grille, such as that in turboshaft engines, turbojet engines, auxiliary power units (APU), terrestrial turbine engines, turbocompressors, etc.

The disclosure also relates to any type of compressor, whether it is axial, centrifugal, mixed, etc.

The compression assembly of a turbine engine according to the disclosure comprises an air inlet duct configured to receive an air flow, an air compression stage comprising a movable compressor wheel onto which the duct discharges and a pre-rotation grille. The pre-rotation grille is positioned in the air inlet duct upstream of the movable compressor wheel in order to rectify the upstream air flow which is directed towards the movable wheel and to adjust the speed at the inlet to the movable wheel. The grille comprises a plurality of variable-setting vanes which extend radially relative to the shaft of the turbine engine and are arranged in the same transverse plane, which is perpendicular to the shaft of the turbine engine.

During operation of the turbine engine, the air penetrates the air inlet duct, passes through the pre-rotation grille and is conveyed as far as the movable compressor wheel. The air flow that is compressed by the movable compressor wheel is then injected into a combustion chamber in order to be mixed with fuel therein and to provide, after combustion, the kinetic energy for rotating one or more turbines.

The turbine engine may of course comprise other compression stages that are arranged between the first compression stage and the combustion chamber.

Figure 1:
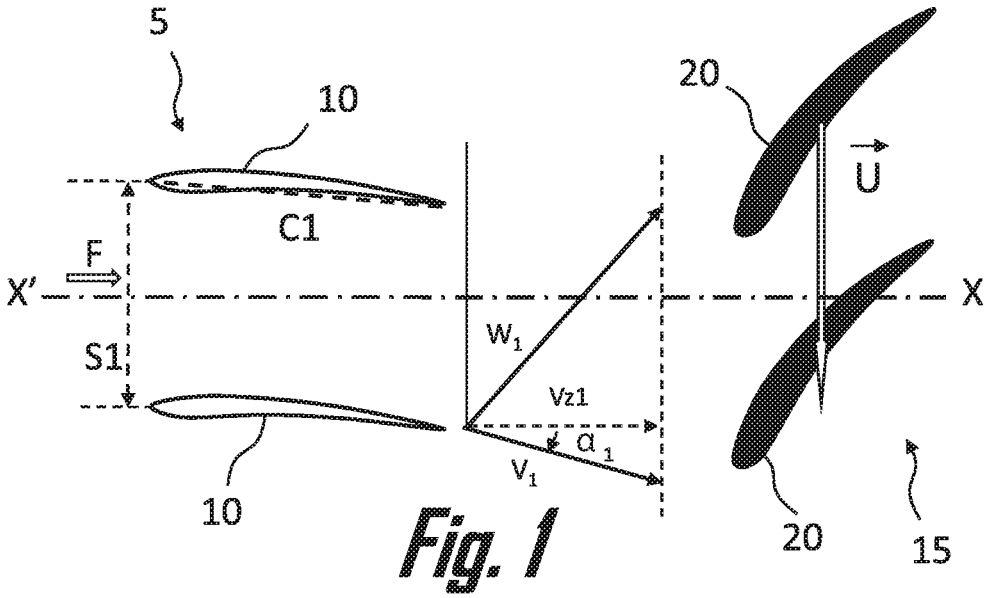
Fig. 1 (PRIOR ART)
FIG. 1 is a cross section of an assembly formed by two vanes of a pre-rotation grille and two blades of a movable wheel of a turboshaft engine of the prior art, the pre-rotation grille being in the open position.
Figure 2:
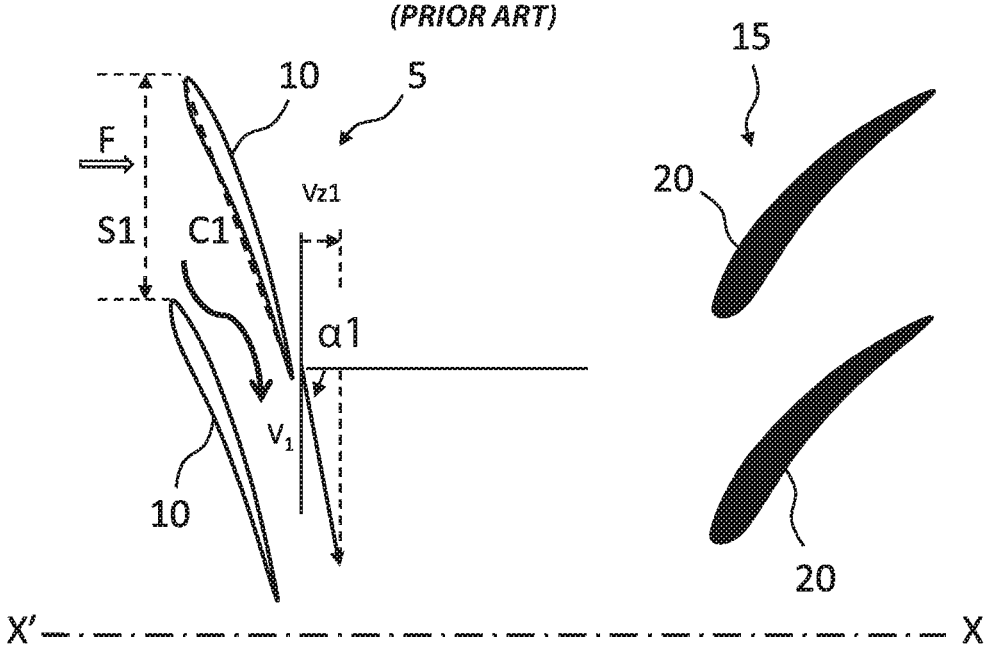
Fig. 2 (PRIOR ART)
FIG. 2 is a cross section of the assembly from FIG. 1 in which the pre-rotation grille is in the closed position.
Figure 3:
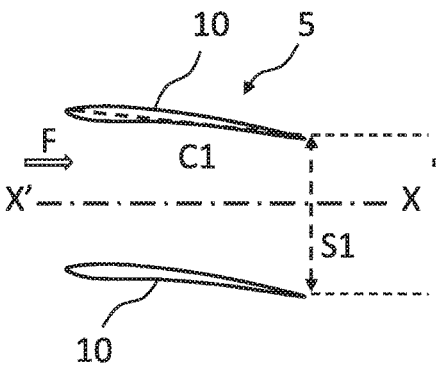
Fig. 3 (PRIOR ART)
FIG. 3 is a cross section of an arrangement of vanes of a pre-rotation grille from the prior art.
Figure 4:
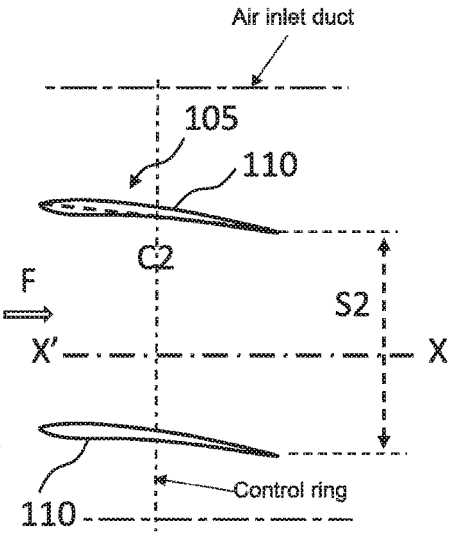
FIG. 4 is a cross section of an arrangement of vanes of a pre-rotation grille according to the disclosure.
Figure 5:
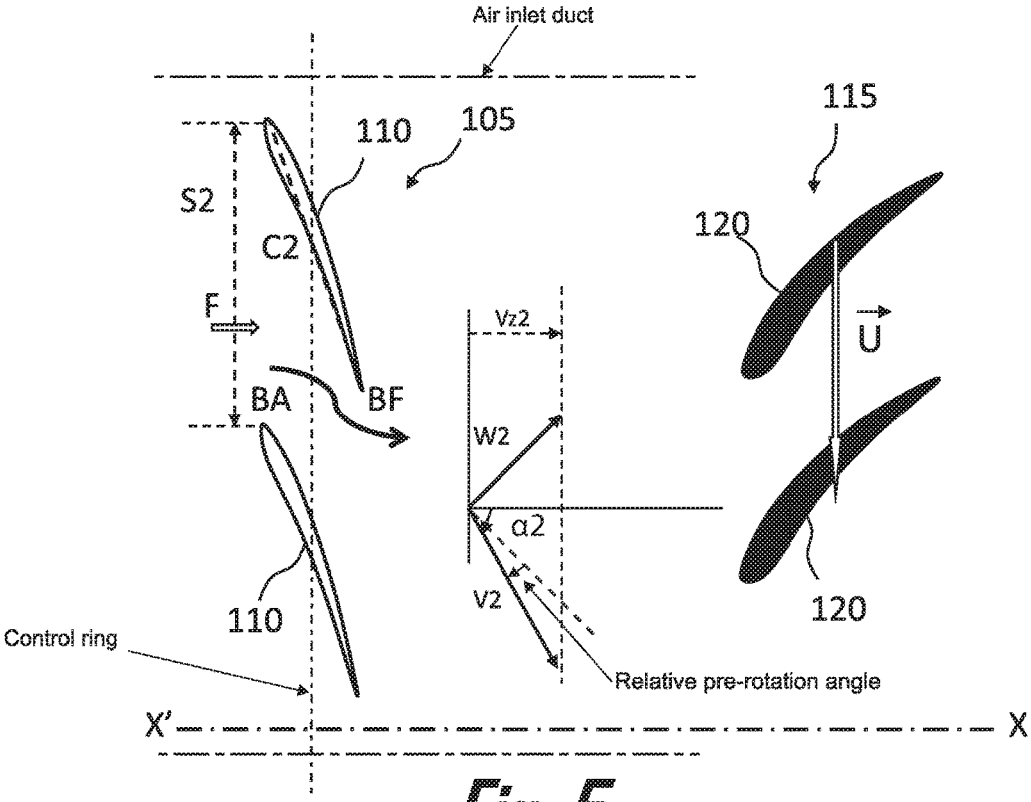
FIG. 5 is a cross section of an assembly formed by two vanes of a pre-rotation grille and two blades of a movable wheel of a turboshaft engine according to the disclosure, the pre-rotation grille being in the closed position.

FIGS. 4 and 5 show an arrangement of two vanes 110 of a pre-rotation grille 105 according to the disclosure. Means (not shown) for controlling the pre-rotation grille 105 allow the vanes 110 of the grille 105 to be oriented in accordance with a setting law for opening/closing the vanes 110 which depends on the rotational speed of the turbine engine. Such a setting law is adjusted in order to ensure a minimal surge margin between the operating line and the surge line.

The vanes 110 of the grille 105 are spaced apart by a pitch S2 and have, between their upstream and downstream ends, that is to say between the leading edge and the trailing edge, a curvature which defines a chord C2.

As shown in FIG. 5, the pre-rotation grille 105 is arranged upstream, in the overall direction of the air flow F, of the blades 120 of the movable compressor wheel 115. The movable wheel 115 is rotated in accordance with the speed vector U so as to accelerate the air flow that is deflected by the pre-rotation grille.

According to the disclosure, the pitch S2 between two consecutive vanes 110 of the grille 5 is greater than the chord C2 of the vanes 110 of the grille 5 at the top of the air duct, such that the vanes 110 do not cover one another in the closed position of the grille 105. The ratio of the pitch S2 to the chord C2, that is to say the parameter S2/C2, may be between 1 and 1.5.

Therefore, at high operating speeds of the compressor (open grille), pre-rotation angle values of the air flow $\alpha 2$ of between 15° and 25° at the top of the air duct allow the relative speed W2 of the air at the inlet to the movable wheel 115 to be significantly reduced and thus allow the efficiency of the compression stage to be significantly improved.

At low operating speeds of the compressor (closed grille), the spacing of the vanes 110 of the grille 105 allows, despite pre-rotation angle values of the vanes of between 80° and 90° at the top of the air duct, smaller pre-rotation angles of the air flow $\alpha 2$ to be obtained and thus allows an axial speed Vz2 to be maintained which is high enough to prevent aerodynamic malfunctions of the movable compressor wheel 115 at low speeds with the pre-rotation grille 105 being set to be closed to a high degree.

Indeed, as shown in FIG. 5, increasing the pitch S2 in comparison with the prior art allows the deflection of the air flow circulating between the leading edge BA of a vane 110 and the trailing edge BF of a consecutive vane 110 of the pre-rotation grille 105 to be limited.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

The invention claimed is:

1. A compression assembly for a turbine engine, said assembly having a longitudinal axis and comprising:

an air inlet duct configured to receive an air flow, the air inlet duct having a bottom and a top;

at least one air compression stage comprising at least one movable compressor wheel onto which the air inlet duct discharges, the movable compressor wheel comprising an axis of rotation which is coaxial with the longitudinal axis of the assembly; and a pre-rotation grille positioned in the air inlet duct immediately upstream of the movable compressor wheel in order to adjust the speed of the air in said air flow at an inlet of the movable wheel, wherein the pre-rotation grille comprises a plurality of variable-setting vanes, the pitch between two consecutive vanes of the plurality of variable-setting vanes being greater than the chord of one of the two vanes when positioned at a selected height within an upper region of the air inlet duct, wherein said air flow at an outlet of the pre-rotation grille flows in a deflection direction, wherein the pre-rotation grille is adjustable between a first, closed position and a second, maximum open position, wherein an absolute pre-rotation angle of the plurality of variable-setting vanes is between 80° and 90° in an upper region of the air inlet duct when the pre-rotation grille is in the closed position at low operating speeds of the compression stage, said absolute pre-rotation angle being an angle between the deflection direction of the air flow and the longitudinal axis of the assembly, wherein a relative pre-rotation angle of the variable-setting vanes of the pre-rotation grille changes depending on the radial distance in the air inlet duct from the longitudinal axis, and wherein the relative pre-rotation angle of the variable-setting vanes is approximately 0° at the bottom of the air inlet duct and is approximately 25° at the top of the air inlet duct when the pre-rotation grille is in the second, maximum open position, said relative pre-rotation angle being an angle between the deflection direction of the air flow and the longitudinal axis of the assembly when the pre-rotation grille is in the open position.

2. The compression assembly according to claim 1, wherein the absolute pre-rotation angle of the plurality of variable-setting vanes is between 15° and 25° in the upper region of the air inlet duct when the pre-rotation grille is in the open position at high operating speeds of the compression stage.

3. The compression assembly according to claim 1, wherein the chord of the plurality of variable-setting vanes is constant for the plurality of variable-setting vanes of the pre-rotation grille.

4. The compression assembly according to claim 1, wherein the plurality of variable-setting vanes are evenly distributed within the air inlet duct.

5. A turbine engine having a longitudinal axis and comprising:

an air inlet duct configured to receive an air flow, the air inlet duct having a bottom and a top;

at least one air compression stage comprising at least one movable compressor wheel onto which the air inlet duct discharges, the movable compressor wheel comprising an axis of rotation which is coaxial with the longitudinal axis of the turbine engine; and a pre-rotation grille positioned in the air inlet duct immediately upstream of the movable compressor wheel in order to adjust the speed of the air in said air flow at an inlet of the movable wheel, wherein the pre-rotation grille comprises a plurality of variable-setting vanes, the pitch between two consecutive vanes of the plurality of variable-setting vanes is greater than the chord of one of the two vanes when positioned at a selected height within an upper region of the air inlet duct, wherein said air flow at an outlet of the pre-rotation grille flows in a deflection direction, wherein the pre-rotation grille is adjustable between a closed position and a fully open position, wherein an absolute pre-rotation angle of the plurality of variable-setting vanes is between 80° and 90° in the upper region of the air inlet duct when the pre-rotation grille is in the closed position at low operating speeds of the compression stage, said absolute pre-rotation angle being an angle between the deflection direction of the air flow and the longitudinal axis of the turbine engine, wherein a relative pre-rotation angle of the plurality of variable-setting vanes of the pre-rotation grille changes depending on the radial distance in the air inlet duct from the longitudinal axis, wherein the relative pre-rotation angle of the plurality of variable-setting vanes is approximately 0° at the bottom of the air inlet duct and is approximately 25° at the top of the air inlet duct when the pre-rotation grille is in the fully open position, said relative pre-rotation angle being an angle between the deflection direction of the air flow and the longitudinal axis of the assembly when the pre-rotation grille is in the open position.

6. A method for controlling a pre-rotation grille of a compression assembly having a longitudinal axis and comprising an air inlet duct configured to receive an air flow, at least one air compression stage comprising at least one movable compressor wheel onto which the air inlet duct discharges, the movable compressor wheel comprising an axis of rotation which is coaxial with the longitudinal axis of the assembly, and a pre-rotation grille positioned in the air inlet duct immediately upstream of the movable compressor wheel in order to adjust the speed of the air in said air flow at an inlet of the movable wheel, the pre-rotation grille comprising a plurality of variable-setting vanes, said air flow at an outlet of the pre-rotation grille flows in a deflection direction, the pre-rotation grille being adjustable between a first, closed position and a second, fully open position, the method comprising:

positioning the plurality of variable-setting vanes of the grille at an absolute pre-rotation angle of between 80° and 90°, said absolute pre-rotation angle being an angle between the deflection direction of the air flow and the longitudinal axis of the assembly, wherein the pitch between two consecutive vanes of the plurality of variable-setting vanes is greater than the chord of one of the two vanes positioned at a selected height within an upper region of the air inlet duct, wherein a relative pre-rotation angle of the plurality of variable-setting vanes of the pre-rotation grille changes depending on the radial distance in the air inlet duct from the longitudinal axis, wherein the relative pre-rotation angle of the plurality of variable-setting vanes is approximately 0° at the bottom of the air inlet duct and is approximately 25° at the top of the air inlet duct when the pre-rotation grille is in the fully open position, said relative pre-rotation angle being an angle between the deflection direction of the air flow and the longitudinal axis of the assembly when the pre-rotation grille is in the open position.

7. The method according to claim 6, further comprising positioning the plurality of variable-setting vanes in the upper region of the air inlet ducts at an absolute pre-rotation angle of between 15° and 25° in the upper region of the air inlet duct and at high operating speeds of the compression stage.

* * * * *